US010596440B2

(12) United States Patent
Verrengia

(10) Patent No.: US 10,596,440 B2
(45) Date of Patent: Mar. 24, 2020

(54) GOLF CLUB TRAINING DEVICE AND SYSTEM

(71) Applicant: Str8 To The Source, Inc, Staten Island, NY (US)

(72) Inventor: Thomas C. Verrengia, Staten Island, NY (US)

(73) Assignee: Staten World Enterprises, LLC, Staten Island, NY (US)

( * ) Notice: Subject to any disclaimer, the term of this patent is extended or adjusted under 35 U.S.C. 154(b) by 0 days.

(21) Appl. No.: 15/722,255

(22) Filed: Oct. 2, 2017

(65) Prior Publication Data

US 2019/0099650 A1 Apr. 4, 2019

(51) Int. Cl.

| | |
|---|---|
| ***A63B 69/36*** | (2006.01) |
| ***A63B 53/10*** | (2015.01) |
| ***A63B 53/04*** | (2015.01) |
| *A63B 53/00* | (2015.01) |

(52) U.S. Cl.

CPC ..... *A63B 69/3635* (2013.01); *A63B 53/0466* (2013.01); *A63B 53/10* (2013.01); *A63B 69/3685* (2013.01); *A63B 2053/005* (2013.01); *A63B 2209/00* (2013.01); *A63B 2220/30* (2013.01); *A63B 2220/833* (2013.01)

(58) Field of Classification Search

CPC ..... A63B 69/3635; A63B 69/3685; A63B 2220/30; A63B 2220/833; A63B 2209/00

USPC ..... 473/215, 219, 224, 226, 228, 233, 234, 473/409

See application file for complete search history.

(56) References Cited

U.S. PATENT DOCUMENTS

| | | | | | |
|---|---|---|---|---|---|
| 1,549,350 | A * | 8/1925 | Deike | A63B 69/3635 | 473/234 |
| 3,468,544 | A * | 9/1969 | Antonious | A63B 53/04 | 473/327 |
| 3,776,556 | A * | 12/1973 | McLaughlin | A63B 69/3635 | 446/216 |
| 3,945,646 | A * | 3/1976 | Hammond | A63B 24/0003 | 473/223 |
| 4,261,566 | A * | 4/1981 | MacDougall | A63B 60/42 | 473/289 |
| 4,283,057 | A * | 8/1981 | Ragan | A63B 53/04 | 473/234 |
| 4,679,791 | A * | 7/1987 | Hull | A63B 53/00 | 473/201 |
| 4,953,868 | A * | 9/1990 | Thompson | A63B 69/3635 | 473/234 |
| 6,173,610 | B1 * | 1/2001 | Pace | A63B 69/0002 | 73/493 |
| 6,290,607 | B1 * | 9/2001 | Gilbert | A63B 53/04 | 473/291 |

(Continued)

*Primary Examiner* — Nini F Legesse

(74) *Attorney, Agent, or Firm* — Scully, Scott, Murphy & Presser, P.C.

(57) ABSTRACT

A golf club training device including: a body having a first end configured to be gripped by a user and a second end longitudinally extended from the first end; and a swing speed sensor disposed at the second end for producing an output signal for determining a portion of a golf swing having a greatest swing speed. A golf club training system is also provided to include: a plurality of the golf club training devices wherein at least two of each of the plurality of golf club training devices having one or more of a different weight and length.

18 Claims, 4 Drawing Sheets

(56) References Cited

U.S. PATENT DOCUMENTS

| | | | | |
|---|---|---|---|---|
| 6,503,149 | B2 * | 1/2003 | Jelinek | A63B 15/00 473/219 |
| 6,709,347 | B1 * | 3/2004 | Ono | A01K 87/00 473/319 |
| 8,491,404 | B2 * | 7/2013 | Kim | A63B 69/3632 473/219 |
| 2003/0027656 | A1 * | 2/2003 | Katsuya | A63B 15/00 473/226 |
| 2009/0275428 | A1 * | 11/2009 | Ikeda | A63B 59/52 473/564 |
| 2011/0159981 | A1 * | 6/2011 | Bazzel | A63B 53/047 473/291 |
| 2013/0085008 | A1 * | 4/2013 | Hall | A63B 69/3632 473/224 |
| 2014/0221125 | A1 * | 8/2014 | Day | A63B 53/04 473/343 |

* cited by examiner

GOLF CLUB TRAINING DEVICE AND SYSTEM

BACKGROUND

1. Field

The present invention relates generally to sporting equipment and, more particularly, to a golf club training device and golf club training system.

2. Prior Art

Golf training devices are known in the art for many aspects of golf, such as putting, and even for swinging a golf club. Those training devices for swinging a golf club mainly focus on training the user to swing the golf club on a particular plane to result in a properly struck golf ball. However, golf club training devices of the prior art fail to adequately train a user to focus the most powerful part of a golf swing at, or about, a point of impact with a golf ball.

SUMMARY

Accordingly, a golf club training device comprising: a body having a first end configured to be gripped by a user and a second end longitudinally extended from the first end; and a swing speed sensor disposed at the second end for producing an output signal for determining a portion of a golf swing having a greatest swing speed.

The first end can be configured as a grip of a golf club.

An intermediate portion of the body between the first and second ends can taper from the first end to the second end, where the second end has a larger outer dimension that an outer dimension of the first end. The first end, second end and intermediate portion can be cylindrical and the outer dimensions of the first and second ends are diameters.

At least a portion of the body can be formed of wood. The wood can be a bamboo laminate.

The swing speed sensor can be one or more whistles. The one or more whistles can be each disposed in a hole formed in the body at the second end, the hole having an axis offset and intersecting with a longitudinal axis of the body. The one or more whistles can comprise two whistles. The two whistles can be offset at the second end along a longitudinal axis of the body. The one or more whistles can have an entry end for intake of airflow, the entry end being recessed from an exterior surface of the body at the second end. The hole can have a tapered portion from the exterior surface to the entry end.

Also provided is a golf club training system comprising: a plurality of golf club training devices, each of the plurality of golf club training devices comprising: a body having a first end configured to be gripped by a user and a second end longitudinally extended from the first end; and a swing speed sensor disposed at the second end for producing an output signal for determining a portion of a golf swing having a greatest swing speed; wherein at least two of each of the plurality of golf club training devices having one or more of a different weight and length.

The first end can be configured as a grip of a golf club.

At least a portion of the body can be formed of wood. The wood can be a bamboo laminate.

The swing speed sensor can be one or more whistles. The one or more whistles can be each disposed in a hole formed in the body at the second end, the hole having an axis offset and intersecting with a longitudinal axis of the body. The one or more whistles can comprise two whistles. The two whistles can be offset at the second end along a longitudinal axis of the body. The one or more whistles can have an entry end for intake of airflow, the entry end being recessed from an exterior surface of the body at the second end. The hole can have a tapered portion from the exterior surface to the entry end.

Still yet provided is a method for training a golf swing, the method comprising: providing a swing speed sensor in a body of a golf club training device to be swung by a user; and during a swing by the user, configuring the swing speed sensor to produce an output signal for determining a portion of the swing having a greatest swing speed.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Figure 1:
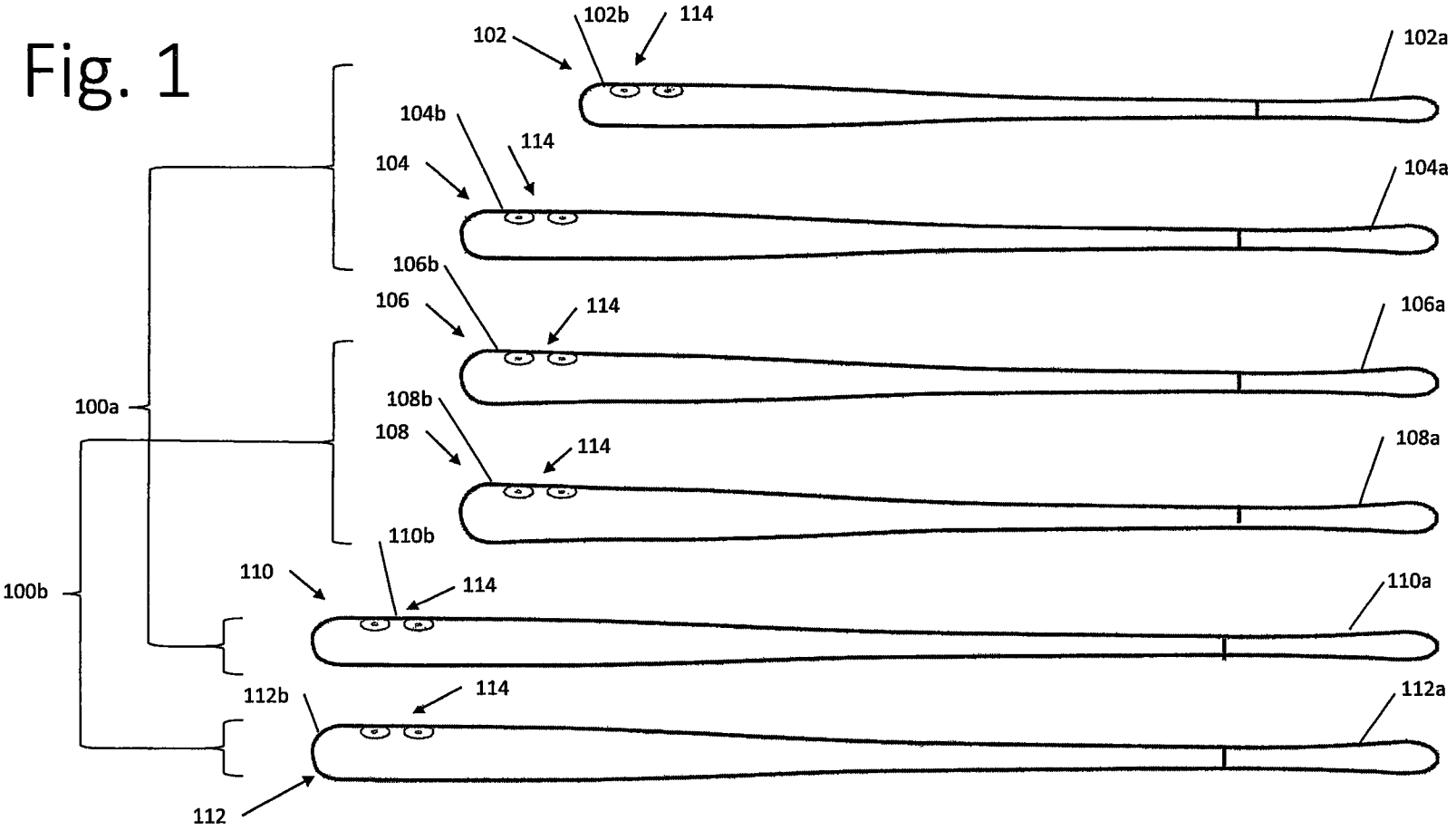
FIG. 1 illustrates a golf club training system of individual golf club training devices.

Referring now to FIG. 1, there is shown two golf club training systems 100*a*, 100*b*, each including individual golf club training devices 102, 104, 106, 108, 110 and 112. Golf club training system 100*a* includes golf club training devices 102, 104 and 110, while golf club training system 100*b* includes golf club training devices 106, 108 and 112. The golf club training devices 102, 104, 106, 108, 110 and 112 can be provided in different configurations, such as having different lengths, weights and end diameters. Such different configurations can be tailored to train for different areas of golf, such as power concentration and/or swing speed. Such different configurations can also be suited for different size and strength golfers, such as men, women and children. Golf club training system 100*a* may be configured to particularly aid in training a women or child/teen while golf club training system 100*a* may be configured to particularly aid in training an adult man. Although golf club training device 104 is shown as being part of system 100*a* and golf club training device 106 is shown as being part of system 100*b*, alternatively, golf club training device 106 can be part of system 100*a* and golf club training device 104 can be part of system 100*b*.

The number of golf club training devices 102, 104, 106, 108, 110 and 112 in each system is illustrated as three, however, any number of golf club training devices 102, 104, 106, 108, 110 and 112 may be provided in a system.

Furthermore, although particular lengths, weights and end diameters of the golf club training devices 102, 104, 106, 108, 110 and 112 are illustrated, such configurations may vary according to particular needs and/or users. A first exemplary configuration is shown as 102 in FIG. 1 having a length of 40", a weight of 18 ounces and a barrel diameter of 1.5". A second exemplary configuration is shown as 104 in FIG. 1 having a length of 45", a weight of 18 ounces and a barrel diameter of 1.65". A third exemplary configuration is shown as 106 in FIG. 1 having a length of 45", a weight of 22 ounces and a barrel diameter of 1.85". A fourth exemplary configuration is shown as 108 in FIG. 1 having a length of 45", a weight of 25 ounces and a barrel diameter of 2". A fifth exemplary configuration is shown as 110 in FIG. 1 having a length of 50", a weight of 18 ounces and a barrel diameter of 1.5". A sixth exemplary configuration is shown as 112 in FIG. 1 having a length of 50", a weight of 22 ounces and a barrel diameter of 1.75".

Furthermore, a first end 102*a*, 104*a*, 106*a*, 108*a*, 110*a* and 112*a* is configured to be held by a user. Such configuration can be the same as that used in a golf club, such as having a length, diameter and/or grip as would be typical for golf clubs. Such grip can be leather or other animal hide, canvas or other fabric, rubber or other elastomer or plastic.

Figures 2A, 2B, 2C:
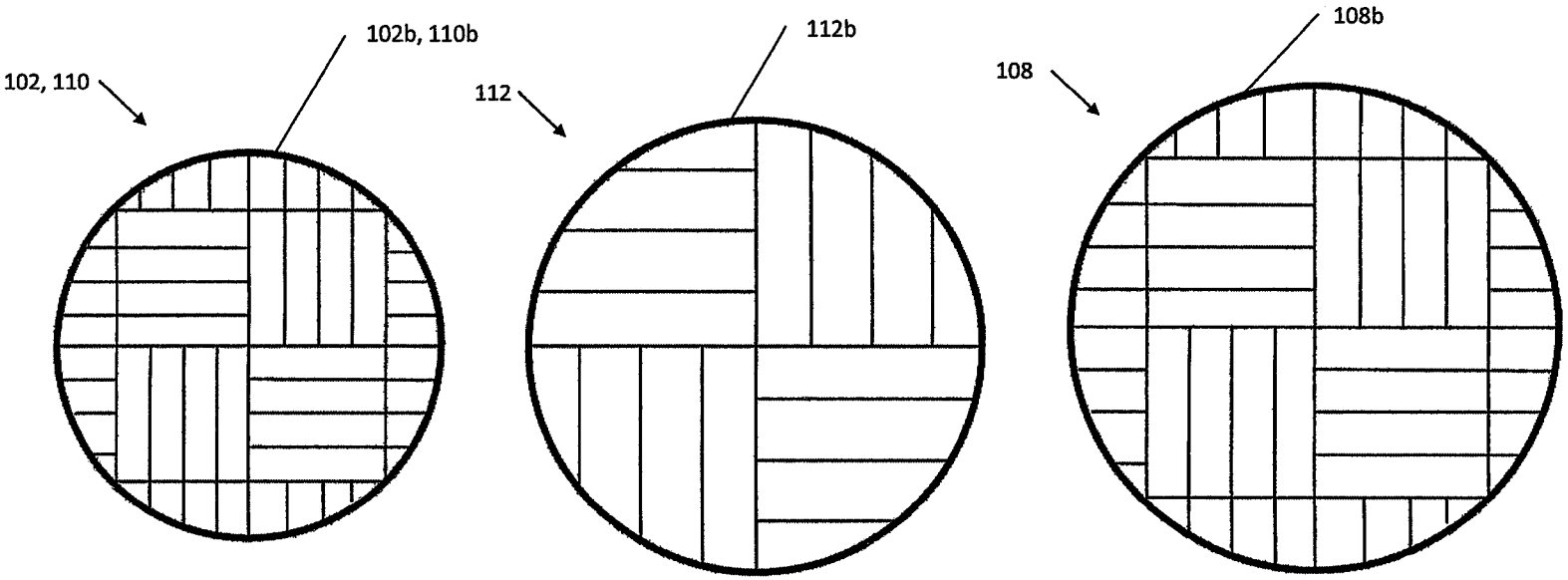
FIG. 2*a* illustrates a cross-section of an individual golf club training device through a first diameter.
FIG. 2*b* illustrates a cross-section of an individual golf club training device through a second diameter.
FIG. 2*c* illustrates a cross-section of an individual golf club training device through a second diameter.

The body of the golf club training devices 102, 104, 106, 108, 110 and 112 can be constructed of any materials known in the sporting arts, such as metal including aluminum, wood, graphite, plastic and the like. However, if a lighter material is used, such as plastic, graphite and plastic that is fabricated with a hollow interior, additional weighting may be necessary if the golf club training devices 102, 104, 106, 108, 110 and 112 are to be tailored to train in improving swing speed. Such weighting can be provided in the hollow interior.

Where wood is used as the material of the body, the wood, particularly if used at a second end 102*b*, 104*b*, 106*b*, 108*b*, 110*b* and 112*b* of the golf club training devices 102, 104, 106, 108, 110 and 112 can alone provide the weight, if necessary. Although the wood can be a single solitary piece of wood formed as known in the art, for example, from the baseball bat art, the body of the golf club training devices 102, 104, 106, 108, 110 and 112, or any portion(s) thereof can be formed of a laminate as shown in FIGS. 2*a*-2*c*. FIG. 2*a* illustrates a sectional view of a wood laminate for a second end having a 1.5" diameter, FIG. 2*b* illustrates a sectional view of a wood laminate for a second end having a 1.75" diameter and FIG. 2*c* illustrates a sectional view of a wood laminate for a second end having a 2" diameter. Furthermore, although typical wood types, such as maple and ash can be used for the body, whether formed in a single solitary piece or of a laminate, the laminate can alternatively be formed of bamboo wood, as is known in U.S. Pat. Nos. 7,771,296; 8,257,207 and 8,870,688, the contents of each of which are incorporated herein by reference.

Furthermore, although illustrated as having a uniform wood construction throughout a length of the body, the golf club training devices 102, 104, 106, 108, 110 and 112 can be constructed with more than one material, such as a wood second end 102*b*, 104*b*, 106*b*, 108*b*, 110*b* and 112*b* and a metal first end 102*a*, 104*a*, 106*a*, 108*a*, 110*a* and 112*a* having a golf grip. Any portion of an intermediate portion of the body between the first and second ends can be either of such materials or another material. Although the first end, second end and intermediate portion are shown being cylindrical in cross section, any shape cross section can be provided for any or all of the first end, second end and intermediate portion of the body.

Each of the golf club training devices 102, 104, 106, 108, 110 and 112 includes one or more swing speed sensors 114 provided at the second ends 102*b*, 104*b*, 106*b*, 108*b*, 110 and 112*b*. The swing speed sensor 114 outputs an indication of where in a golf swing is the greatest swing speed, which would also correspond to the same portion of the golf swing that would produce the greatest power. In the illustrated embodiment, the swing speed sensor is a whistle 114*a* embedded in the second end and configured such that an air flow through the whistle during the golf swing produces an audible output and such audible output can be differentiated at the portion of the swing having the greatest swing speed (corresponding to the greatest air flow through the whistle).

Figures 3A, 3B:
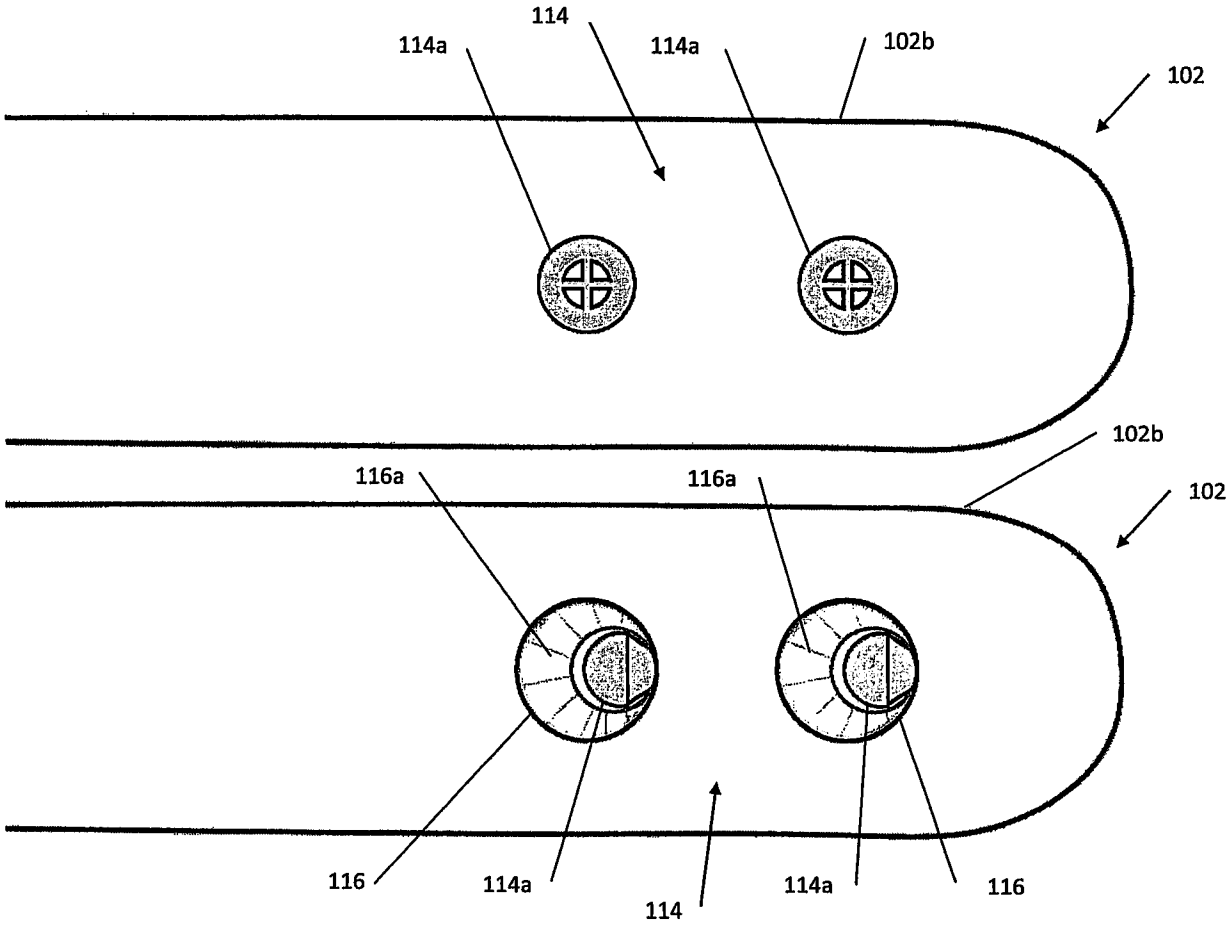
FIG. 3*a* illustrates a view of a first side of an end of an individual golf club training device.
FIG. 3*b* illustrates a view of a second side of the end of the individual golf club training device of FIG. 3*a*.
Figure 4A:
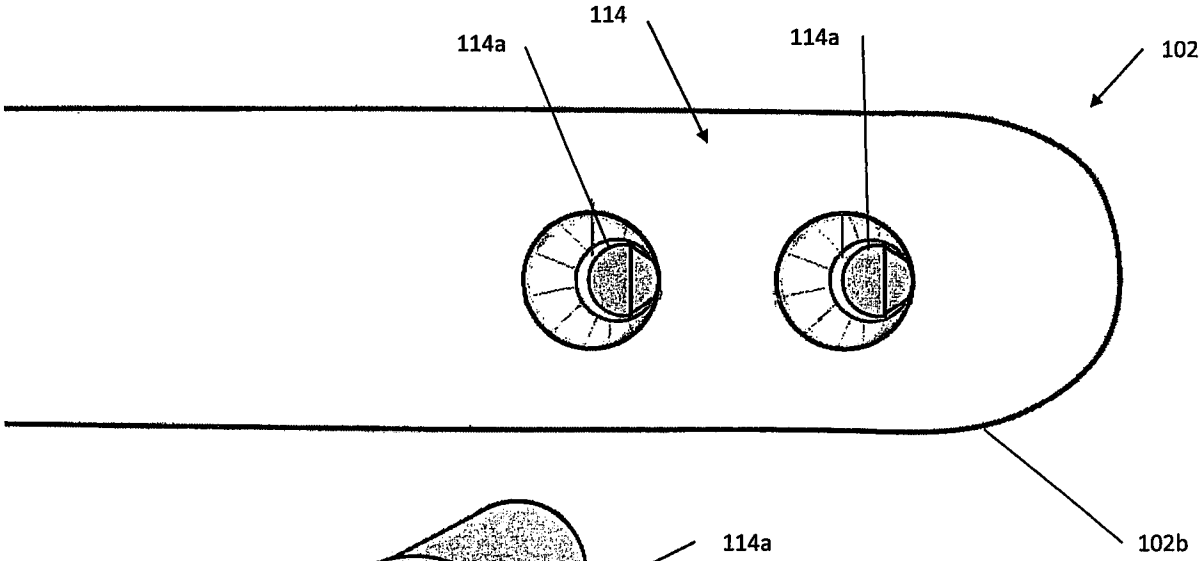
FIG. 4*a* illustrates an embodiment of a whistle arrangement at the end of an individual golf club training device.

As shown in FIGS. 3*a*, 3*b* and 4*a*, two whistles 114*a* can be provided as the swing speed sensor 114 in the second end 102*b*, 104*b*, 106*b*, 108*b*, 110*b* and 112*b* of the golf club training device 102, 104, 106, 108, 110 and 112. For illustrative purposes, golf club device 102 is illustrated in FIGS. 3*a*, 3*b* and 4*a*. However, each of the golf club training devices 102, 104, 106, 108, 110 and 112 can be similarly configured. FIG. 3*a* shows an output side of the whistles 114*a* from a first side of the second end 102*b* while FIG. 3*b* shows an entry end of the whistles 114*a* from a second side of the second end 102*b*. The output side of the whistles 114*a* can be provided flush with an exterior surface at the second end and the entry end 116 can be recessed from such exterior surface such that the second end can be configured to have a tapered hole 116*a* for funneling air flow into the whistle 114*a*. When swung by the user, the leading side of the golf club training device 102 would be the side having the entry end 116. Furthermore, a whistle 114*a* can be used that produces the audio output from air entering either side.

Figure 4B:
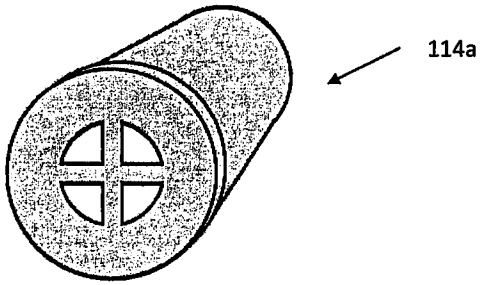
FIG. 4*b* illustrates a swing speed sensor, in the form of a whistle, for use at the end of the individual golf club training device.

FIG. 4*a* further illustrates an embodiment of a relative orientation of the whistles 114*a*. In FIG. 4*a*, such whistles 114*a* are configured along a longitudinal axis of the elongated body of the golf club training device 102 with the entry end 116 being recessed below the exterior surface of the second end 102*b*, such as at a depth of ⅝", such that the tapered hole 116*a* is formed leading into such entry end 116, where the tapered hole can have a diameter of 0.78" at the surface of the golf club training device 102. Such whistles can also be configured near the furtherest portion of the second end (relative to the first end) corresponding to the portion of the body having the greatest swing speed and configured to be relatively close to each in a longitudinal direction. Although configured as shown in FIG. 4*a*, the whistle 114*a* can be configured in any way that produces the audible output signal which can be distinguished for the portion of the golf swing having the greatest swing speed. Furthermore, although two whistles 114*a* are shown, one or more than two can be provided. FIG. 4*b* illustrates a whistle 114*b* for use in the second end 102*b*. Such whistle 114*a* can be formed from any material, such as plastic or metal and disposed in the second end 102*b* in any way, such as press fitted, adhered or threaded.

Although a whistle 114*a* is illustrated as the swing speed sensor 114, other swing speed sensors can be provided, such as a air flow sensor powered by a battery, where the air flow sensor outputs a signal to another device, such as a speaker. The signal can be proportionate to the air flow measured. Such signal can be input directly to the speaker or other device or first input to a processor for controlling the speaker or other device. Where the other device is a speaker, the processor can control the speaker to produce an audible signal having a volume, pitch, sound different for different swing speeds or only produce an audible signal at a maximum swing speed. The speaker and/or processor can be provide in the golf club training device 102, 104, 106, 108, 110 and 112 or provided separately, such as in a smart phone connected wirelessly to the air flow sensor, such as by Bluetooth. Furthermore, other outputs can be provided by the swing speed sensor, such as a graphical representation of swing speed displayed on a display, such as the display of a smart phone or a tactical response, such as a vibration from in the golf club training device 102, 104, 106, 108, 110 and 112.

Although described with regard to determining a portion of the golf swing having maximum power, the golf club training devices 102, 104, 106, 108, 110 and 112 may also be useful for determining whether the club head (corresponding to the second end) is squared to the golf ball at the point of impact of the golf ball. For example, the swing speed sensor can be configured to also detect a directional flow of air which would indicate whether the swing speed sensor is oriented to receive maximum air flow or offset from such orientation (indicating that the second end is not square at impact). In this regard, a same swing speed sensor may be used to detect both the portion of maximum power and second end orientation, such as the whistle having a different output depending on its orientation relative to the air flow direction (the direction of the swing plane) or having no output where the orientation is incorrect. For example, the whistle can make a louder sound when a direction of a longitudinal axis of the whistle is on the swing plane and a lower sound (or no sound) where the direction of the longitudinal axis of the whistle is not on the swing plane (such longitudinal axis is offset and intersecting with the swing plane indicating an open or closed clubface). Alternatively, different whistles or sets of whistles can be provided offset from the ones shown in FIG. 4*a*, such as being offset circumferentially with regard to each other such that their longitudinal axes intersect. For example, two sets of whistles can be provided each having a different distinct sound (one set can make a distinct whistle sound, the other can make a duck call sound, when the golf club training device is swung correctly, the user hears the whistle, when it is swung incorrectly, to have an open or closed second end, the user hears the duck call).

In use, the golf club training devices, when swung like a golf club, create a whistle sound to determine the portion of the swing having the maximum power. If the user hears the whistle behind him/her, their swing isn't proper because the maximum power occurs too early in the swing. Similarly, if the user hears the whistle sound in front of him/her, their swing also is improper because the maximum power occurs too late in the swing. The whistle sound should heard by the user at the portion of the user's swing down near where the ball would be so that the maximum power in the swing occurs at or about the point of impact with the ball. Therefore, the user is provided feedback, such as an audio signal from the whistle 114*a*, or other feedback from another type of swing speed sensor 114, as to where to locate the maximum swing speed in the golf swing (as the swing is approaching where the ball would be and going through where the ball would be to maximize power at and through impact). Identification of maximum power too far behind the ball or too far in front of the ball would aid the user to correct his/her swing to change the portion of the swing where the maximum power is being generated.

With regard to the golf club training system 100*a*, 100*b*, the individual golf club training devices thereof can be configured to train for both focusing the power at the proper portion of the swing and to also increase such maximum power by increasing swing speed.

Thus, each individual golf club training device in the system 100*a*, 100*b* can have a different effect and train a different area (e.g., point of power and maximize power). The smaller length golf club training devices can be used to develop speed, the heavier weight golf club training devices can be used to develop strength and power and those golf club training devices having a combination of length and weight can be used to develop speed and power.

While there has been shown and described what is considered to be preferred embodiments, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A golf club training device comprising:

a body having a first end configured to be gripped by a user and a second end longitudinally extended from the first end, the first and second ends each having a round cross-sectional shape where a diameter of the second end is greater than a diameter of the first end;

a golf grip disposed on the first end;

the second end is configured as a baseball bat; and a swing speed sensor disposed at the second end for producing an output signal for determining a portion of a golf swing having a greatest swing speed;

wherein a length of the body is in a range of 40-50 inches; and a weight of the body is in a range of 18-25 ounces.

2. The golf club training device of claim 1, wherein at least a portion of the body is formed of wood.

3. The golf club training device of claim 2, wherein the wood is a bamboo laminate.

4. The golf club training device of claim 1, wherein the swing speed sensor is one or more whistles.

5. The golf club training device of claim 4, wherein the one or more whistles are each disposed in a hole formed in the body at the second end, the hole having an axis intersecting with a longitudinal axis of the body.

6. The golf club training device of claim 5, wherein the one or more whistles have an entry end for intake of airflow, the entry end being recessed from an exterior surface of the body at the second end.

7. The golf club training device of claim 6, wherein the hole has a tapered portion from the exterior surface to the entry end.

8. The golf club training device of claim 4, wherein the one or more whistles comprises two whistles.

9. The golf club training device of claim 8, wherein the two whistles are offset relative to each other along a longitudinal axis of the body.

10. A golf club training system comprising:

a plurality of golf club training devices, each of the plurality of golf club training devices comprising:

a body having a first end configured to be gripped by a user and a second end longitudinally extended from the first end, each of the first and second ends having a round cross-sectional shape where a diameter of the second end is greater than a diameter of the first end;

a golf grip disposed on the first end;

the second end is configured as a baseball bat; and a swing speed sensor disposed at the second end for producing an output signal for determining a portion of a golf swing having a greatest swing speed;

wherein a length of the body of each of the plurality of golf club training devices is in a range of 40-50 inches;

a weight of the body of each of the plurality of golf club training devices is in a range of 18-25 ounces; and each of the plurality of golf club training devices having one or more of a different weight and length.

11. The golf club training system of claim 10, wherein at least a portion of the body is formed of wood.

12. The golf club training system of claim 11, wherein the wood is a bamboo laminate.

13. The golf club training system of claim 10, wherein the swing speed sensor is one or more whistles.

14. The golf club training system of claim 13, wherein the one or more whistles are each disposed in a hole formed in the body at the second end, the hole having an axis intersecting with a longitudinal axis of the body.

15. The golf club training system of claim 14, wherein the one or more whistles have an entry end for intake of airflow, the entry end being recessed from an exterior surface of the body at the second end.

16. The golf club training system of claim 15, wherein the hole has a tapered portion from the exterior surface to the entry end.

17. The golf club training system of claim 13, wherein the one or more whistles comprises two whistles.

18. The golf club training system of claim 17, wherein the two whistles are offset at the second end along a longitudinal axis of the body.

* * * * *